United States Patent [19]

Katz

[11] Patent Number: 4,940,973

[45] Date of Patent: Jul. 10, 1990

[54] METHOD AND APPARATUS FOR DISPLAYING GRAPHIC AND ALPHANUMERIC DATA

[75] Inventor: Beatriz E. Katz, Buenos Aires, Argentina

[73] Assignee: Alternative Energy Research Center Inc., Panama

[21] Appl. No.: 172,282

[22] Filed: Mar. 23, 1988

[30] Foreign Application Priority Data

Apr. 1, 1987 [EP] European Pat. Off. ..... 87104786.6

[51] Int. Cl.[5] ..... G09G 3/34

[52] U.S. Cl. ..... 340/764; 340/783; 340/815.27; 40/446; 264/1.9

[58] Field of Search ..... 340/763, 764, 783, 815.24, 340/815.26, 815.27, 815.1; 40/430, 446, 463, 466, 470, 473; 350/269, 273; 264/1.9

[56] References Cited

U.S. PATENT DOCUMENTS

| | | | |
|---|---|---|---|
| 1,799,731 | 4/1931 | Cassels . | |
| 3,772,686 | 11/1973 | Chardon | 340/815.26 |
| 4,336,536 | 6/1982 | Kalt et al. | 340/764 |
| 4,558,529 | 12/1985 | Chang et al. . | |
| 4,695,837 | 9/1987 | Kalt | 340/764 |
| 4,769,638 | 9/1988 | Woolfolk | 340/763 |

FOREIGN PATENT DOCUMENTS

| | | |
|---|---|---|
| 2042152 | 8/1970 | Fed. Rep. of Germany . |
| 3026876 | 7/1980 | Fed. Rep. of Germany . |
| 921341 | 8/1961 | United Kingdom . |

OTHER PUBLICATIONS

IBM Disclosure Bulletin, vol. 1, No. 5 (Feb. 1959).

*Primary Examiner*—Jeffery A. Brier

*Attorney, Agent, or Firm*—Lerner, David, Littenberg, Krumholz & Mentlik

[57] ABSTRACT

A method and apparatus for displaying the graphic and alphanumeric data of the type utilizing pixel matrix panels with an outside light source. The method comprises reflecting the outside light on a preselected colored surface, rotatably housed within each matrix pixel.

Every pixel comprises a cylindrical container (1) having a transparent non-flat cap (3) at one of bases, the other base being missing. The container (1) houses a radiation deflector (5) and a hollow cylinder (7) having two or more reflecting areas (10), differently colored, located on its lateral surface (9).

An external light radiation enters the container through the cap (3), is deflected by the deflector (5) and is reflected by one of the reflecting areas to be again deflected and directed to the outside.

The hollow cylinder (7) is operated by an electromagnetic control so as to alternatively present to the deflected radiation a preselected colored area.

24 Claims, 2 Drawing Sheets

Fig. 1
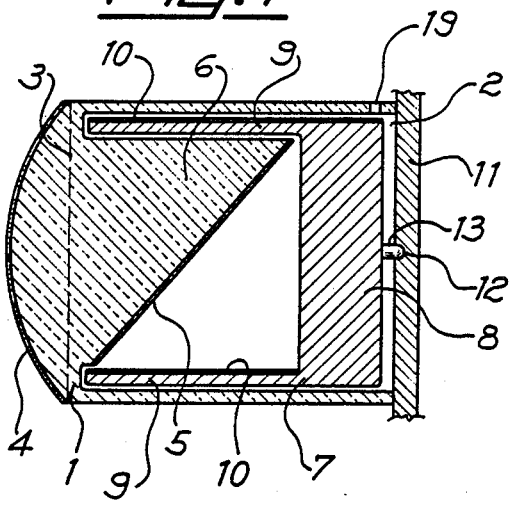
Fig. 2
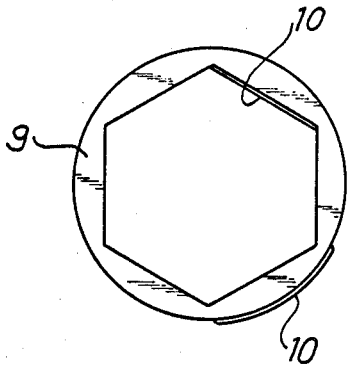
Fig. 3
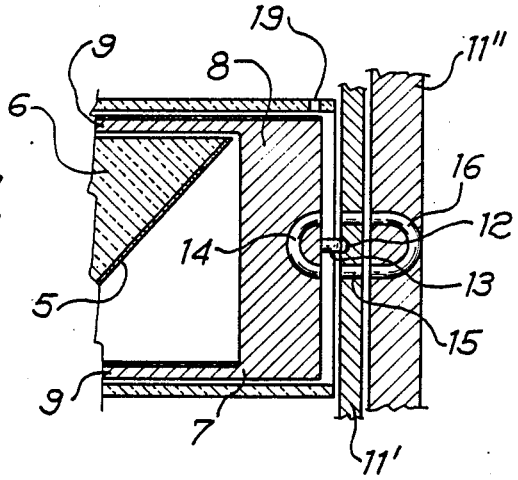
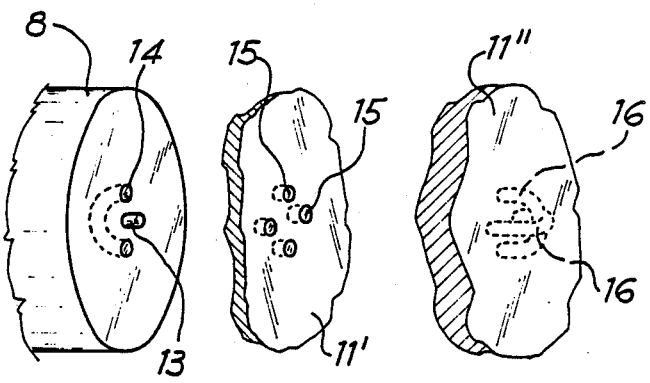
Fig. 4

METHOD AND APPARATUS FOR DISPLAYING GRAPHIC AND ALPHANUMERIC DATA

BACKGROUND OF THE INVENTION

1. Field of the Invention

This invention relates to an outside light source display for black and white and/or colour visualization of graphic or alphanumerical data. The display has been particularly designed for an outdoor use utilizing sunlight as a light source, but it can work as well with artificial light by night and indoor. Also, the invention, utilizing pixel matrix panels, has a modular structure, thus covering a wide range of dimensions according to each particular need, from the shop to the stadium.

2. Description of the Prior Art

As it is known, display apparatuses divide into two main families according to where the light source is. Displays with an internal light source can be those using a matrix of LEDs or of incandescent lamps, or those utilizing a matrix of video monitors each showing a portion of the whole image. They both are rather expensive and require a high power consumption of many kWatts per square meter. The display apparatuses utilizing an outside light source can be represented by the common display used in airports and/or stations to give passangers the required information about leaving/arriving times etc. The messages are formed by rotation of a number of tesseras, each mounted by one of its sides on a support rod as sheets in a book. These displays do not require a high power consumption and are quite resistant, but they can show only a number of predetermined messages and images. Moreover they must be kept free from dust, thus limiting their use outside.

Another apparatus utilizing an outside light source is a matrix based display, each matrix comprising a number of plaques or cubes with differently coloured faces which are magnetically or mechanically rotated. Also this display is affected by dust, even if it has a transparent external surface: the dust accumulated on the cube faces has to be cleaned away to restore the original colours brightness. Both these two latter displays are rather economical and they can preserve the message also during a power failure, but their use outdoor is limited by their bad resistance to varying weather, they are not flexible enough, and the ratio of representative surface versus total surface is too low. Thus the need remains of a display apparatus which: utilizes pixels matrix panels, where the pixels have dimensions going from about 5 mm to about 50 mm. and can have at least 3 colours plus black and white; is weather resistant and without openings, so that it can easily be washed; has a representative efficiency which is more than 80%; can preserve the message also during a power failure; requires a low capacity, of about 50 watts per square meter; has a modular structure, where each module is easily replaceable; and utilizes an outside light source.

SUMMARY OF THE INVENTION

An object of this invention is therefore to provide a method and an apparatus for displaying information having the mentioned requirements.

Accordingly, the invention provides a method for visualizing black and white and/or color graphic and/or alphanumerical communications, of the type utilizing pixel matrix panels with an outside light source, characterized in that, in connection with every pixel, luminous energy is drawn from the outside through a transparent surface and is deflected by a radiation deflector to hit one of two or more coloured reflecting areas belonging to a movable element; the thus reflected radiation is again deflected and sent outside through the same transparent surface; said movable element being shiftable in such a way that the entering deflected radiation hits one of its coloured reflecting areas selected at will.

The invention also provides an apparatus for visualizing black and white and/or colour graphic and/or alphanumeric communications, of the type utilizing pixel matrix panels with an outside light source, characterized in that every pixel comprises: a container or cell open on one side and having one surface made of a transparent material; a radiation deflector; a movable element having two or more differently coloured reflecting areas, one of which is struck by the deflected light radiation; a drive for controlled shifting of said movable element, in order to put one of its coloured areas in a reflecting position of the deflected light radiation.

According to another aspect of the present invention, it is also provided a process for making a module or submatrix as above stated, characterized in that: a module casing is made by injection molding of a transparent polymeric material, said casing having a plurality of non-flat caps, and having, connected with each cap, a radiation deflector and a cylindrical recess closed by said radiation deflector; a plurality of hollow rotatable cylinders are separately made, each cylinder having an open base, a number of coloured reflecting areas placed on its inner or outer lateral surface, and a permanent magnet or a metal sector on its closed base; each hollow cylinder is placed in one cylindrical recess; the matrix is closed with a plate having electromagnets facing each hollow cylinder base; a vacuum is obtained inside the matrix by means of passages connecting said cylindrical recess and a port connecting the inside of the matrix with the environment; the matrix is nearly completely filled with a dielectric fluid; the cited environment connecting port is closed; and the outside of the non-flat caps is covered with a multidieletric and/or antiscratch material.

The invention is described in detail in the following passages of the specification referring to the accompanying drawings, which however are merely illustrative of how the invention might be put into effect. So the specific form and arrangement of the invention features shown are not to be understood as limiting the invention.

In the drawings:

BRIEF DESCRIPTION OF THE DRAWINGS

FIG. 1 is a cross sectional view of one possible form of a pixel;

FIG. 2 is a front sectional view of one possible form of a reflecting device contained in the pixel of FIG. 1;

FIG. 3 is a partial view similar to FIG. 1 where an electromagnetic control of the device of FIG. 2 is shown;

FIG. 4 is a perspective view of the apparatus of FIG. 3

DESCRIPTION OF THE PREFERRED EMBODIMENTS

Figure 5:
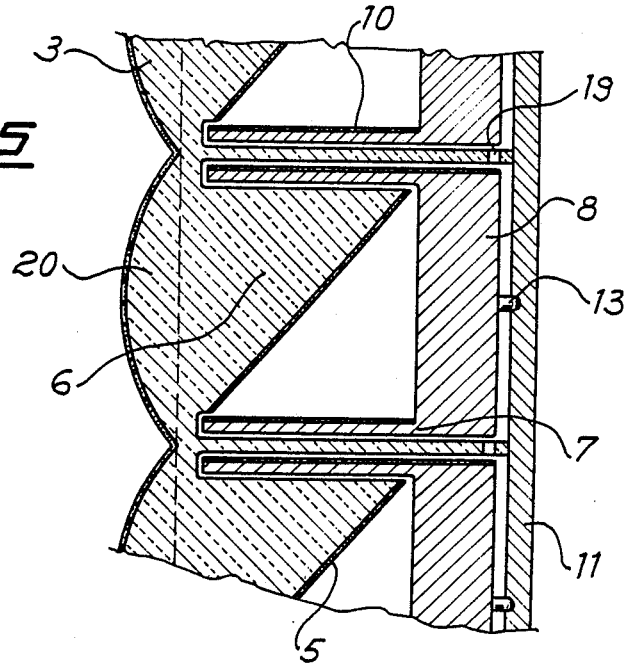
FIG. 5 is a partial cross sectional view of a matrix comprising many pixels each integral with each other to form a module.

The example pixel as shown in FIG. 1 includes a hollow body 1 which serves as a container or cell, has a cylindrical shape and is open on its base 2. The closed base is shaped as a non-flat cap 3, spherical or not spherical according to end-use requirements and is made of transparent material, which in the preferred embodiment is a polymeric transparent material. The cap 3 defines the representative surface of the pixel and to this purpose is coated with one or more layers 4 of a multidielectric and/or scratch resistant material.

Inside the cell 1, near the inner surface of cap 3 is located a radiation deflector 5 which can be made integral with the cell 1.

In this case the whole cell 1 can be made of injection molded transparent polymeric material and the radiation deflector 5 can be any deflecting device, but preferably is a mirror or a layer of deflecting material placed on the protuding part 6 of cell 1. In the shown preferred embodiment the deflector is at 45° with the cell optical axis, but it can be placed also at different angles.

Inside the cell 1 a hollow cylinder 7 is placed having a radius not much smaller than that of the cell 1. The cylinder 7 is missing of one of its bases, thus being formed by a base 8 and a lateral surface 9 on which coloured reflecting areas 10 are located. These areas 10 can be located on the inner side or on the outer side of the cylinder lateral surface 9; in the latter case the lateral surface 9 should be made of transparent material. The cylinder 7 is placed into cell 1 with the radiation deflector 5 partially housed within the cylinder 7, with the base 8, thereof, partially closing the cell 1.

The coloured reflecting areas 10 generally consist of a layer of coloured reflecting material plated on the inner or outer side of the lateral surface 9. In one possible embodiment of the invention, the cylinder 7 has a polygonal section comprising a plurality of level areas, as shown in FIG. 2, each having its longitudinal axis parallel to the cell optical axis, and each plated with a differently coloured reflecting material, thus forming the areas 10. In this case, the cylinder 7 and protuding part 6 are so sized as to allow a free cylinder rotation about its own axis. The cell 1 is sealingly closed on its back by a plate 11 which also serves as a pivoting support for the cylinder 7 by having on the cylinder rotation axis a pinhole 12 mating with a pin 13 located on the base 8 of cylinder 7.

Obviously the pin and pinhole can be arranged vice-versa. When the example pixel of FIG. 1 is exposed to a light source (natural or artificial), the radiation enters the pixel through the layer 4, the cap 3 and the protuding part 6 to be deflected by the radiation deflector 5. In this case the light is deflected substantially at 90° and hits that reflecting area 10 which is located perpendicularly to the deflected light rays, forming on and within said area 10 an elongated focal spot having roughly the same area as the transparent cap 3. The thus reflected radiation is again deflected by the deflector 5 and sent to the outside through the same protruding part 6, cap 3 and layer 4.

In order to select another reflecting area 10, for changing the colour appearing through the cap 3, the cylinder 7 is rotated on its pivoting support consisting of the mating pin 13 and pinhole 12. Any convenient device may be used to this purpose; in FIGS. 3 and 4 a preferred embodiment is shown, consisting in an electromagnetic drive. In the embodiment utilizing an electromagnetic drive shown in FIGS. 3 and 4, the base 8 of cylinder 7 houses a permanent magnet 14 whose poles are symmetrically disposed about the cylinder rotation axis. The closing plate 11 consists of two separate plates 11' and 11", namely a closing plate 11' and a supporting plate 11". The closing plate 11' is located near the base 8 and houses a pair of magnetizable elements 15 for every couple of axially opposed reflecting areas 10. These elements 15 are placed symmetrically to the cylinder rotation axis, at the same distance from said rotation axis as said poles of permanent magnet 14.

Outside and near plate 11' is located a plate 11" which removably houses one electromagnet 16 for each pair of magnetizable elements 15. The electromagnets 16 are aligned with the corresponding pairs of magnetizable elements 15 and they can be selectively activated by means of electrodes to selectively magnetize one couple of elements 15, thus controlling the rotation of magnet 14 and cylinder 7.

Every pixel is sealingly closed by the closing plate 11 but it is also provided with an orifice 19 through which air is driven from the inside of the pixels by means of a suction device (not shown) to be replaced by a dielectric fluid. This fluid preferably is a silicone oil, and it fills nearly completely all the unoccupied spaces inside the pixel so that only a small volume of gas, not interfering with the radiation path, is left therein, to allow for thermal contractions and expansions.

Figure 6:
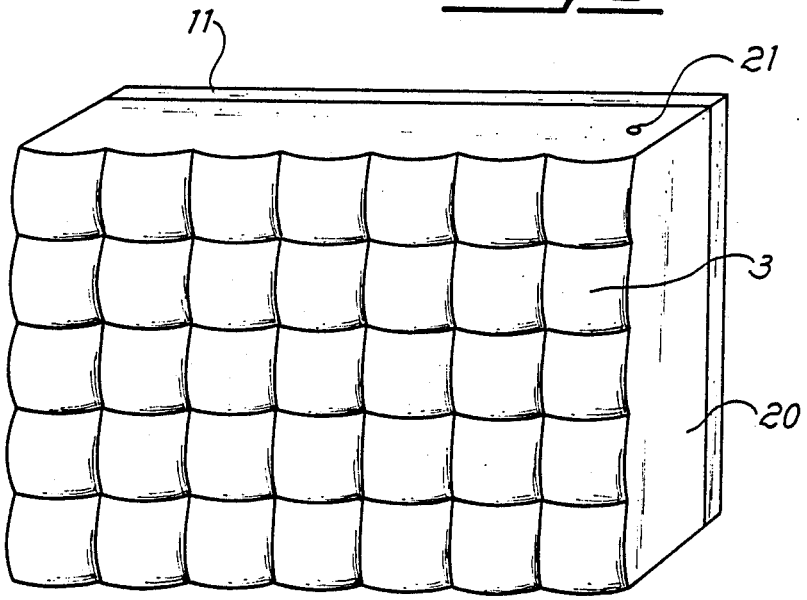
FIG. 6 is a perspective view of the matrix module of FIG. 7.

The final display apparatus may be made of a number of single pixels, but it is preferred to have a matrix panel consisting of two or more modules. As shown in FIGS. 5 and 6, each module comprises a casing 20, preferably made by injection molding, which has a plurality of caps 3, each connected with a hollow sleeve-like cylinder forming a plurality of cells 1. Each cell houses the same radiation deflector 5 and hollow cylinder 7 previously described; also the pivoting support 12, 13 and the electromagnetic drive are the same, while only one closing plate 11 is used, wide enough for the whole structure. Each pixel communicates with the next one through the orifice 19, and only one of them communicates with the outside through a last closable orifice 21. The whole module is first put under vacuum and then filled with the cited dielectric fluid leaving only a small amount of gas housed in a plurality of housings in the upper side of the module to allow for thermal expansions and contractions.

As previously cited, electromagnets 16 are energized by means of electrodes connected to a computer; in a matrix panel having N pixels per column and M pixels per line, the total number of electrodes necessary to control the display is $2N+aM$, where "a" is the number of coloured reflecting areas 10, while the total electrodes in a four colour panel of the present state of the art are $6N\times M$.

It will be clear from the foregoing description that the present invention provides an effective economical and resistant display apparatus, which is ideally suited for outdoor and daylight use.

I claim:

1. A method for displaying data utilizing a matrix panel of pixels and an outside light source, comprising: drawing light from the outside through a transparent surface on said pixels; deflecting said light by a radiation deflector to hit a reflecting surface corresponding to one of at least two coloured areas belonging to a movable element; deflecting said light reflected from said reflecting surface to the outside back through said transparent surface; said movable element being shiftable such that said light deflected by said radiation deflector strikes a selected one of said coloured areas.

2. A method according to claim 1, including generating a lighted area within the reflecting surface having roughly the same dimension as that of the transparent surface.

3. A method according to claim 1, including shifting said movable element by rotating said element, said element being substantially cylindrical with its axis of rotation substantially perpendicular to the transparent surface, and wherein said radiation deflector deflects light radiations substantially at 90°.

4. A method according to claim 3, including electromagnetically controlling said movable element.

5. An apparatus for displaying data utilizing a matrix panel of pixels and an outside light source, each of said pixels comprising: a cell having a side open and a surface made of a transparent material; a radiation deflector; a movable element having at least two differently coloured reflecting areas, each of said at least two reflecting areas being alignable with said radiation deflector so that it can be struck by light deflected by said radiation deflector; and a drive for controlled shifting of said movable element in order to put one of said coloured reflecting areas in alignment with said radiation deflector for receiving light deflected from said radiation deflector.

6. An apparatus according to claim 5, wherein said surface of said cell made of transparent material comprises the surface of said pixel displaying said data and said surface is made of a transparent polymeric material coated with at least one layer of a material selected from the group consisting of a multidielectric material and an antiscratch material.

7. An apparatus according to claim 5 or 6, wherein said cell is shaped as a cylinder whose bases are said open side and said surface made of a transparent material.

8. An apparatus according to claim 6, wherein said radiation deflector is situated inside the cell, near the inner surface of said cap, and deflects light radiations substantially at 90°.

9. An apparatus according to claim 8, wherein said radiation deflector is integral with the cell.

10. An apparatus according to claim 8 or 9, wherein said radiation deflector is a mirror placed at 45° with reference to the cell optical axis.

11. An apparatus according to claim 5, wherein said movable element is a hollow cylinder having an open base and a closed base and is located in said cell such that said open base transmits light deflected by the radiation deflector, and said coloured reflecting areas are situated on the lateral surface of said hollow cylinder.

12. An apparatus according to claim 11, wherein said hollow cylinder has a polygonal cross-section and comprises a plurality of differently coloured planar reflecting areas, each having its longitudinal axis parallel to the cell optical axis.

13. An apparatus according to claim 11, wherein said cell is closed on its back by a plate or the like, and said plate and the closed base of said hollow cylinder have a pin-pinhole connection for rotatably supporting said hollow cylinder.

14. An apparatus according to claim 13, wherein said closed base of said hollow cylinder houses a permanent magnet, integral with said base, whose two poles are symmetrical about the axis of rotation of said cylinder.

15. An apparatus according to claim 14, wherein said plate has at least one electromagnet which can be selectively activated to control rotations of said permanent magnet, and of said hollow cylinder integral therewith, in alignment with the poles of said electromagnet.

16. An apparatus according to claim 15, wherein said plate permanently houses magnetizable elements symmetrically arranged with reference to the axis of rotation of said hollow cylinder.

17. An apparatus according to claim 15, wherein said electromagnet is activated by means of electrodes connected with said electromagnet.

18. An apparatus according to claim 5, wherein unoccupied volumes inside said cell are nearly completely filled with a dielectric fluid, except for a small amount of gas.

19. An apparatus according to claim 18, wherein said fluid is silicone oil.

20. An apparatus according to claim 5, wherein a plurality of the pixels comprising said panel form a module, the surfaces made of a transparent material of each pixel are aligned to form the front surface of said module, and said module is closed on the back surface by one plate or the like.

21. An apparatus according to claim 20, wherein the cells of said pixels are hydraulically connected with each other and the unoccupied volumes inside said cells are completely filled with a dielectric fluid, except for a small volume of gas housed in a plurality of cells in the upper side of the module.

22. An apparatus according to claim 6, wherein said surface of said cell made of transparent material is in the shape of a non-flat cap.

23. A process for the construction of an apparatus for displaying data utilizing a matrix panel of pixels and an outside light source, comprising: making a module casing by injection molding of a transparent polymeric material, said casing having a plurality of non-flat caps, and having, connected with each cap, a radiation deflector and a cylindrical recess closed by said radiation deflector; making separately a plurality of hollow rotatable cylinders, each cylinder having an open base and a closed base, a number of coloured reflecting areas on its lateral surface, and a permanent magnet on its closed base; placing one of said hollow cylinders in each of said cylindrical recesses; closing said casing with a plate having electromagnets facing the closed base of each hollow cylinder; creating a vacuum inside the casing by means of passages connecting said cylindrical recesses and a port connecting the inside of the casing with the environment; filling the matrix nearly completely with a dielectric fluid; closing said port; and covering the outside of the non-flat caps with a material selected from the group consisting of a multidielectric material and an antiscratch material.

24. An apparatus for displaying data utilizing a matrix panel of pixels and an outside light source, comprising: means for drawing light from the outside through a transparent surface on said pixels; means for deflecting said light by a radiation deflector to hit a reflecting surface corresponding to one of at least two coloured areas belonging to a movable element; means for deflecting said light reflected from said reflecting surface to the outside back through said transparent surface; and means for shifting said movable element to cause said light deflected by said radiation deflector to strike a selected one of said coloured areas.

* * * * *

UNITED STATES PATENT AND TRADEMARK OFFICE

CERTIFICATE OF CORRECTION

PATENT NO. : 4,940,973

DATED : July 10, 1990

INVENTOR(S) : Beatriz E. Katz

It is certified that error appears in the above-identified patent and that said Letters Patent is hereby corrected as shown below:

In Abstract, line 8, after "one of" insert --its--.
Column 3, line 26, cancel the word "of".
Column 5, line 6, "within" should read --on--.

Signed and Sealed this

Twelfth Day of November, 1991

*Attest:*

HARRY F. MANBECK, JR.

*Attesting Officer*

*Commissioner of Patents and Trademarks*